US006962259B2

(12) United States Patent
Hu

(10) Patent No.: US 6,962,259 B2
(45) Date of Patent: Nov. 8, 2005

(54) DYNAMIC SHOWING RACK

(76) Inventor: Shin Hung Hu, No. 104, Sec. 3, Cheng Der Rd., Taipei (TW)

( * ) Notice: Subject to any disclaimer, the term of this patent is extended or adjusted under 35 U.S.C. 154(b) by 206 days.

(21) Appl. No.: 10/698,446

(22) Filed: Nov. 3, 2003

(65) Prior Publication Data

US 2005/0092697 A1 May 5, 2005

(51) Int. Cl.[7] ..... A47F 3/08
(52) U.S. Cl. ..... 211/1.51; 211/186
(58) Field of Search ..... 211/1.51, 186, 211/121, 134, 175, 182, 144; 108/20, 180, 108/186, 187, 190

(56) References Cited

U.S. PATENT DOCUMENTS 4,673,092 A * 6/1987 Lamson et al. ..... 211/188
5,022,533 A * 6/1991 Lin ..... 211/1.51
5,971,174 A * 10/1999 Strock ..... 211/186
6,062,150 A * 5/2000 Sikora et al. ..... 108/190
6,092,475 A * 7/2000 Langer et al. ..... 108/188
6,163,992 A * 12/2000 Chou ..... 40/411

* cited by examiner

*Primary Examiner*—Jennifer E. Novosad
(74) *Attorney, Agent, or Firm*—Rosenberg, Klein & Lee

(57) ABSTRACT

A dynamic showing rack mainly includes four main posts, each of which further includes a plurality of serially connected connecting posts, knuckles, and spindles. The knuckle has flat upper and lower sides, and a bearing mounted therein. The connecting post has two bevel end surfaces, and the spindle is extended through the bearing with two ends held in the bevel end surfaces of two connecting posts separately located at upper and lower sides of the knuckle, so that two connecting posts are obliquely extended from one knuckle in different directions. A motor is connected to the spindle in one of the lowest connecting posts to turn and swing the connecting post, and accordingly, all main posts of the rack to create a dynamic showing effect.

2 Claims, 8 Drawing Sheets

DYNAMIC SHOWING RACK

FIELD OF THE INVENTION

The present invention relates to a dynamic showing rack, and more particularly to a showing rack that produces turning and/or swinging movements to create a dynamic display effect to attract consumers.

BACKGROUND OF THE INVENTION

Most showing racks used in general shops, department stores, and malls for displaying and showing merchandise are different in shape and size, but they are normally a fixed type for showing products in a static manner. Such still racks lack the ability of attracting busy consumers and therefore could not create good advertising or displaying effect. Most sellers try to highlight the showing racks using specially designed lighting and color light, but it seems to have little help to do so.

SUMMARY OF THE INVENTION

A primary object of the present invention is to provide a dynamic showing rack that may be caused to turn and/or swing and thereby provides special and dynamic view to attract consumers' attention to the attention to the ry products displayed on the rack.

The dynamic showing rack mainly includes four main posts, each of which further includes a plurality of serially connected connecting posts, knuckles, and spindles. The knuckle has flat upper and lower sides, and a bearing mounted therein. The connecting post has two bevel end surfaces, and the spindle is extended through the bearing with two ends held in the bevel end surfaces of two connecting posts separately located at upper and lower sides of the knuckle, so that two connecting posts are obliquely extended from one knuckle in different directions. A motor is connected to the spindle in one of the lowest connecting posts to turn and swing the connecting post, and accordingly, all main posts of the rack to create a dynamic showing effect.

The spindle is provided near two ends at two opposite sides with two recesses, and the connecting post is provided on each end surface with a fixing hole and near each end surface with a lateral screw hole communicating with the fixing hole. The spindle is held at two ends in the fixing holes on the end surfaces of two connecting posts by extending screws through the lateral screw holes into the recesses on the spindle, such that the spindle is adapted to transmit a turning force from one connecting post to a next connecting post.

The four main posts are interconnected with one another to form the rack by connecting crossbars to and between two opposite knuckles on the main posts, and positioning flat shelves on the crossbars for supporting products thereon.

Alternatively, the connecting post may have a curved body and flat end surfaces to achieve the same turning and swinging effect on the showing rack.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
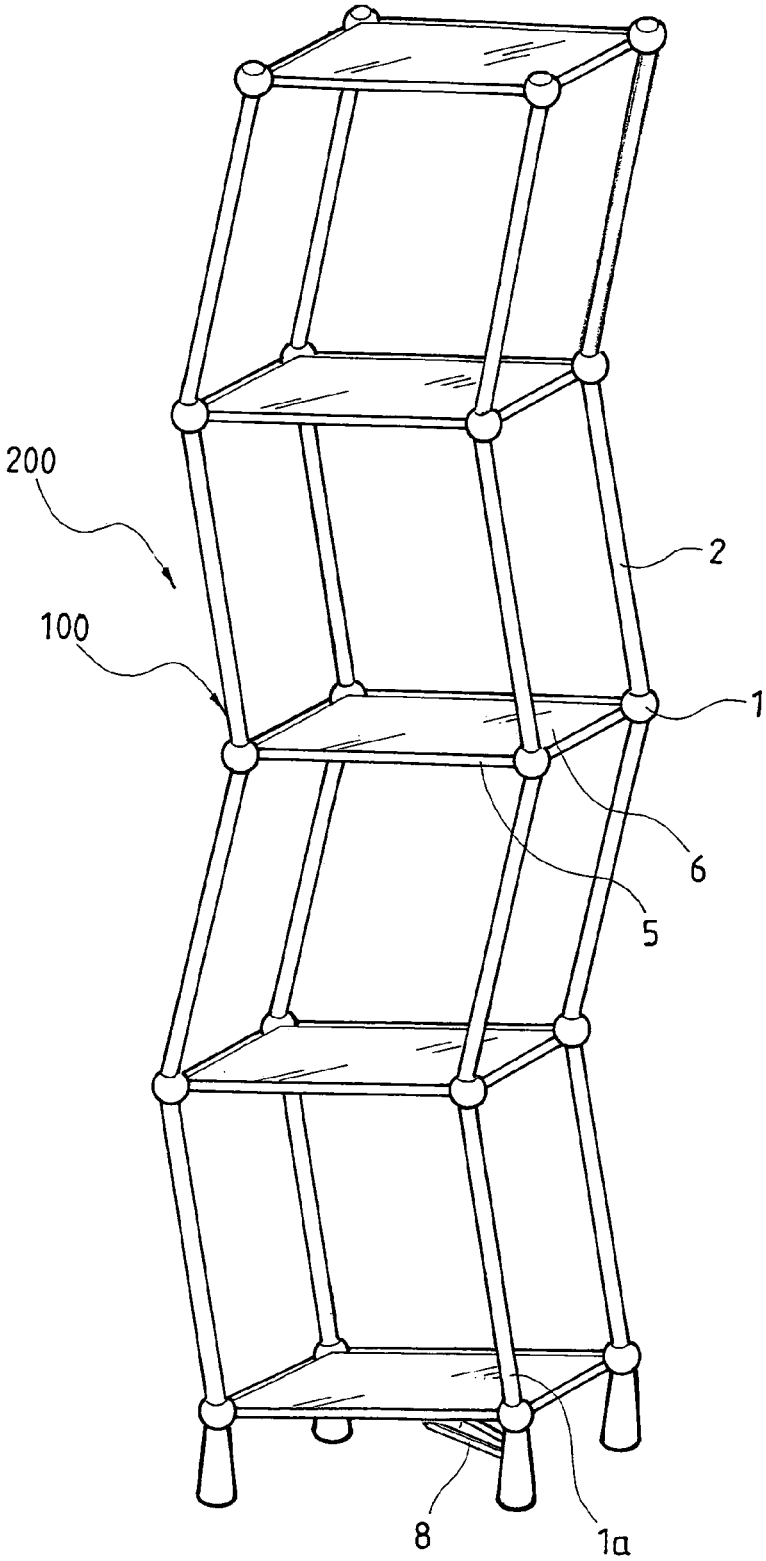
FIG. 1 is a perspective view of a dynamic showing rack according to a first embodiment of the present invention.
Figure 2:
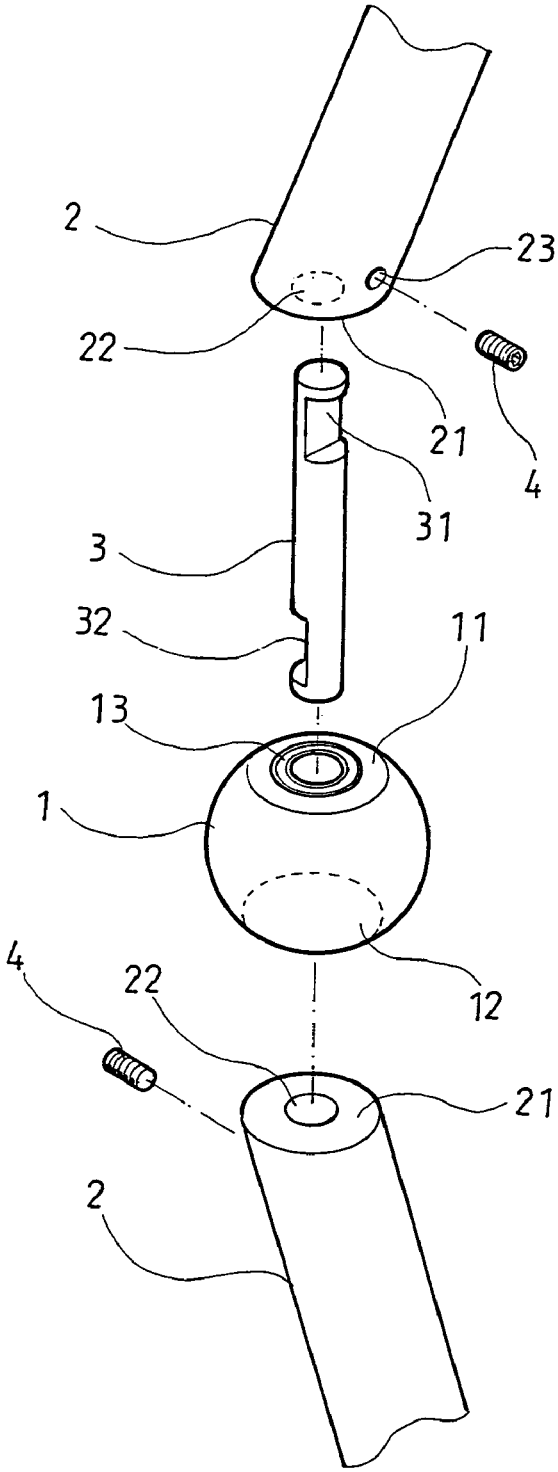
FIG. 2 is a fragmentary exploded perspective view showing connection of two vertical connecting posts to a knuckle of the dynamic showing rack of FIG. 1.
Figure 3:
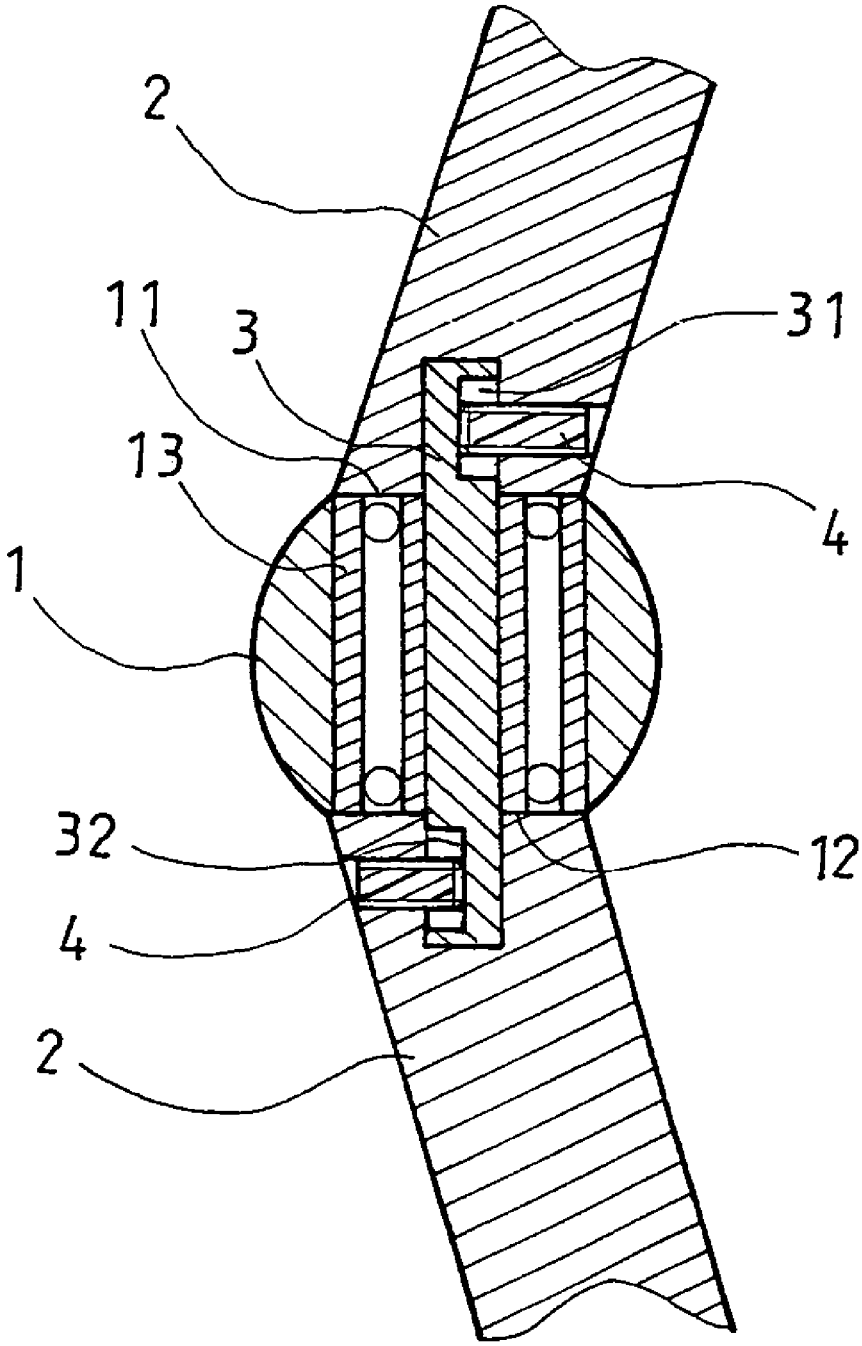
FIG. 3 is an assembled sectional view of FIG. 2.

Please refer to FIGS. 1, 2, and 3 at the same time. The present invention mainly includes a plurality of knuckles 1 and connecting posts 2. Each of the knuckles 1 has flat upper and lower sides 11, 12, and is internally provided with a bearing 13. Each of the connecting posts 2 has two beveled end surfaces 21. Each beveled end surface 21 is provided with a fixing hole 22. A substantially lateral screw hole 23 is provided near each end of the connecting post 2 to communicate with the fixing hole 22.

A plurality of spindles 3 in the form of round bars having a diameter slightly smaller than a central bore of the bearing 13 in the knuckle 1 are provided. Each of the spindles 3 is provided at upper and lower ends at two opposite sides with two recesses 31, 32. The spindle 3 is extended through the bearing 13 with the upper and lower ends separately fitted in the fixing holes 22 of an upper and a lower connecting post 2, respectively, so that the flat upper and lower sides 11, 12 of the knuckle 1 contact with the beveled end surfaces 21 of the upper and the lower connecting posts 2. In this manner, the two connecting posts 2 would obliquely extend from the knuckle 1 in two different directions. Screws 4 are then threaded into the screw holes 23 on the connecting posts 2 to hold the spindle 3 at two ends to the upper and lower connecting posts 2. After a plurality of connecting posts 2 are serially connected via the knuckles 1 and the spindles 3, a vertical main post 100 showing a series of bends is formed. Thereafter, crossbars 5 are connected at two ends to two opposite knuckles 1 on four main posts 100, and flat shelves 6 made of, for example, glass or acrylic sheets are laid on the crossbars 5 to form a rack 200. A lowest connecting post 2*a* in one of the four main posts 100 is connected at its spindle 3*a* to a motor 9 (see FIG. 4). When the motor 9 is started, the main post 100 connected thereto is caused to pivotally turn or swing, so that the whole rack 200 is caused to turn or swing.

Figure 4:
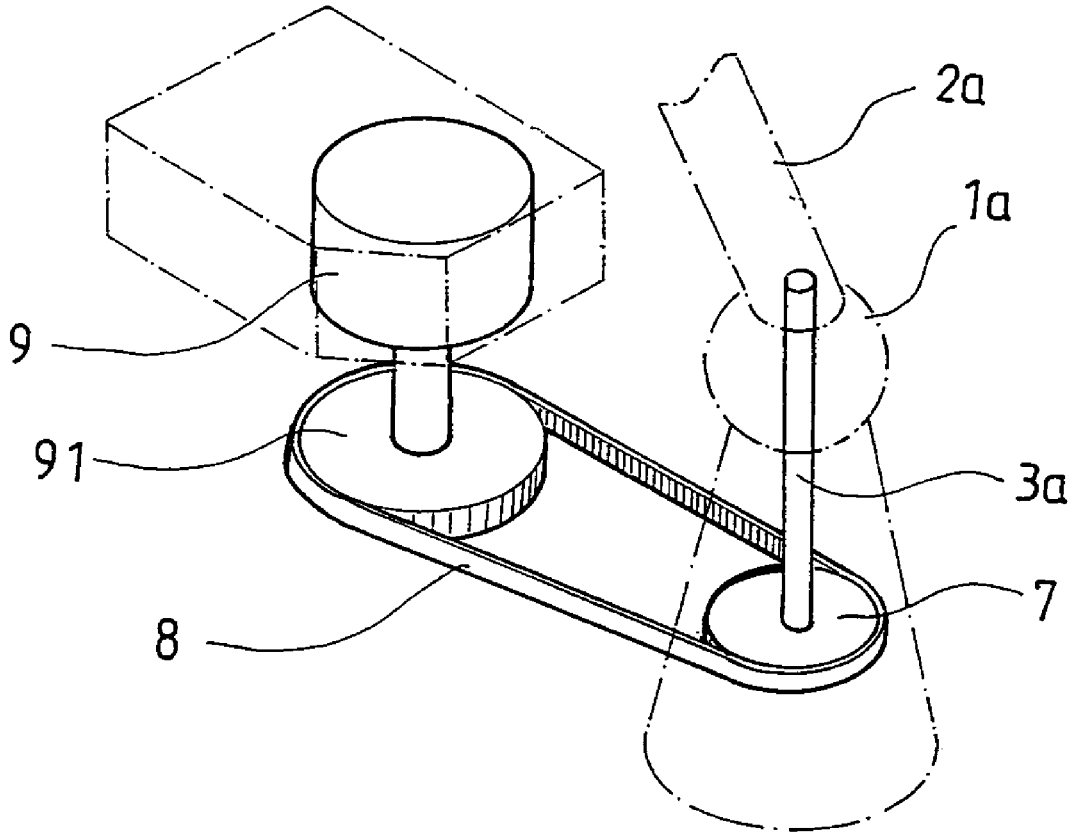
FIG. 4 is a perspective view of a driving mechanism working with the showing rack of FIG. 1.

Please refer to FIG. 4. The lowest connecting post 2*a* of one of the four main posts 100 has a spindle 3*a* that downward extends by a predetermined length to pivotally connect to a gear 7, which is connected via a transmission belt 8 to a driving gear 91 rotatably connected to the motor 9. When the motor 9 is started, the transmission belt 8 is brought to move and thereby rotates the spindle 3*a*, causing the whole rack 200 to turn and swing.

Figure 5:
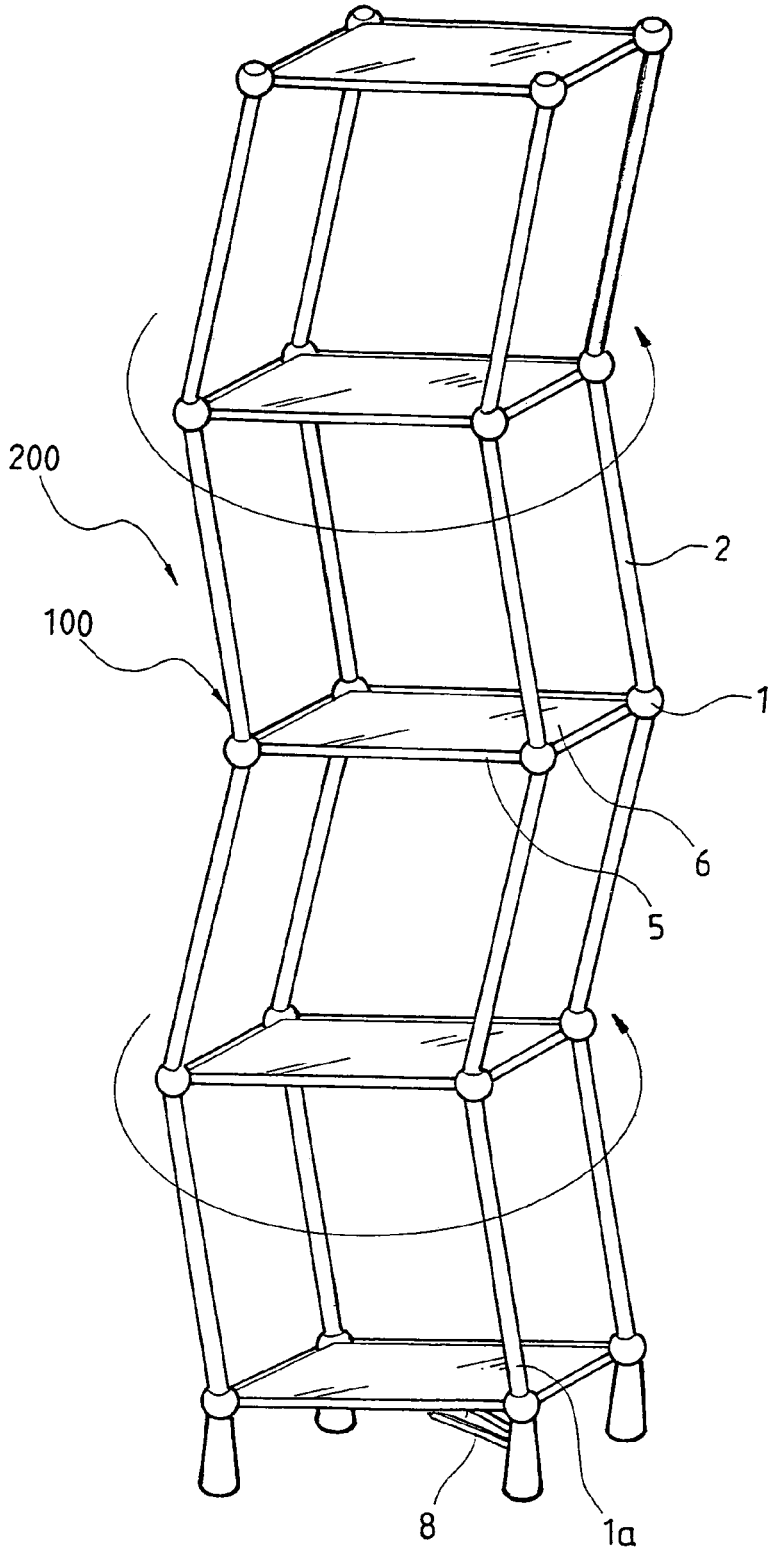
FIG. 5 shows the dynamic showing rack of FIG. 1 in a swinging state.
Figure 6:
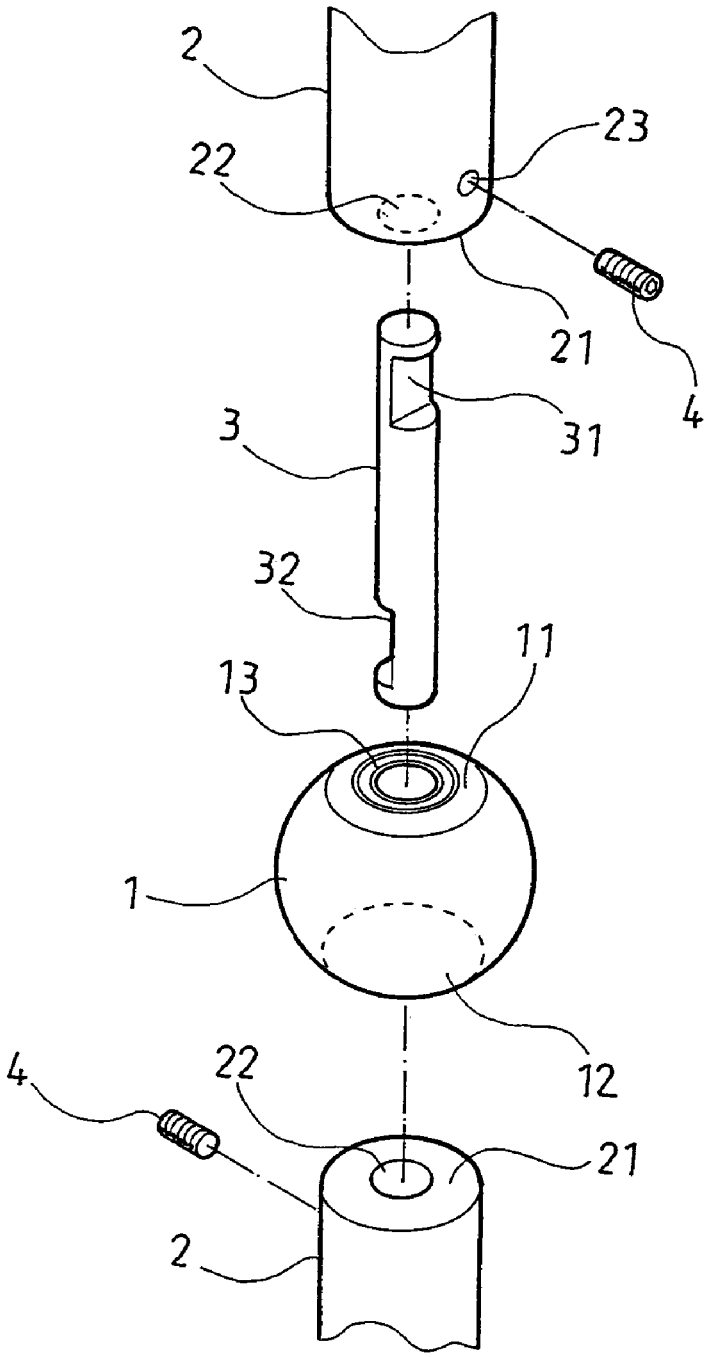
FIG. 6 a fragmentary exploded perspective view showing connection of two vertical connecting posts to a knuckle of the dynamic showing rack according to a second embodiment of the present invention.
Figure 7:
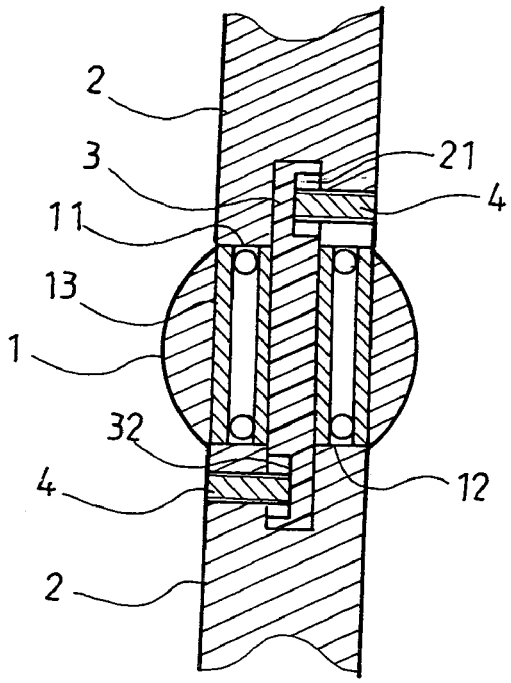
FIG. 7 is an assembled sectional view of FIG. 6.
Figure 8:
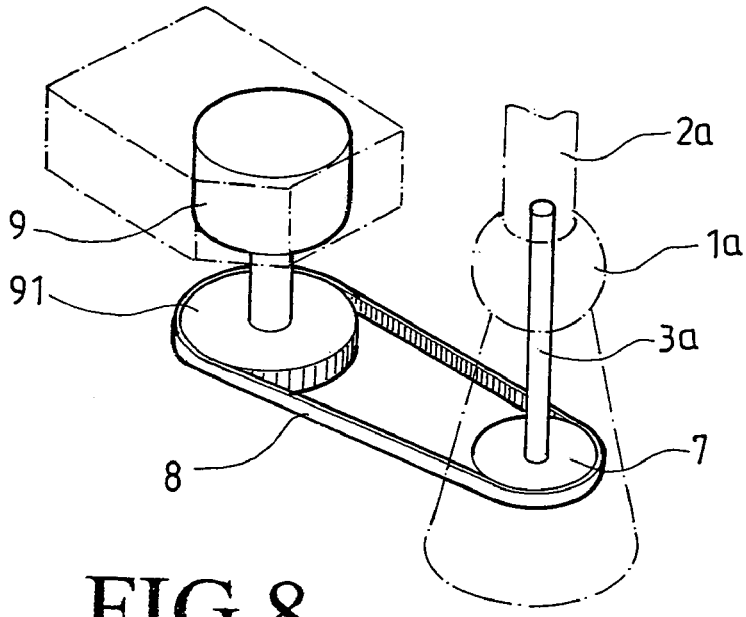
FIG. 8 is a perspective view of the driving mechanism working with the showing rack of FIG. 6.
Figure 9:
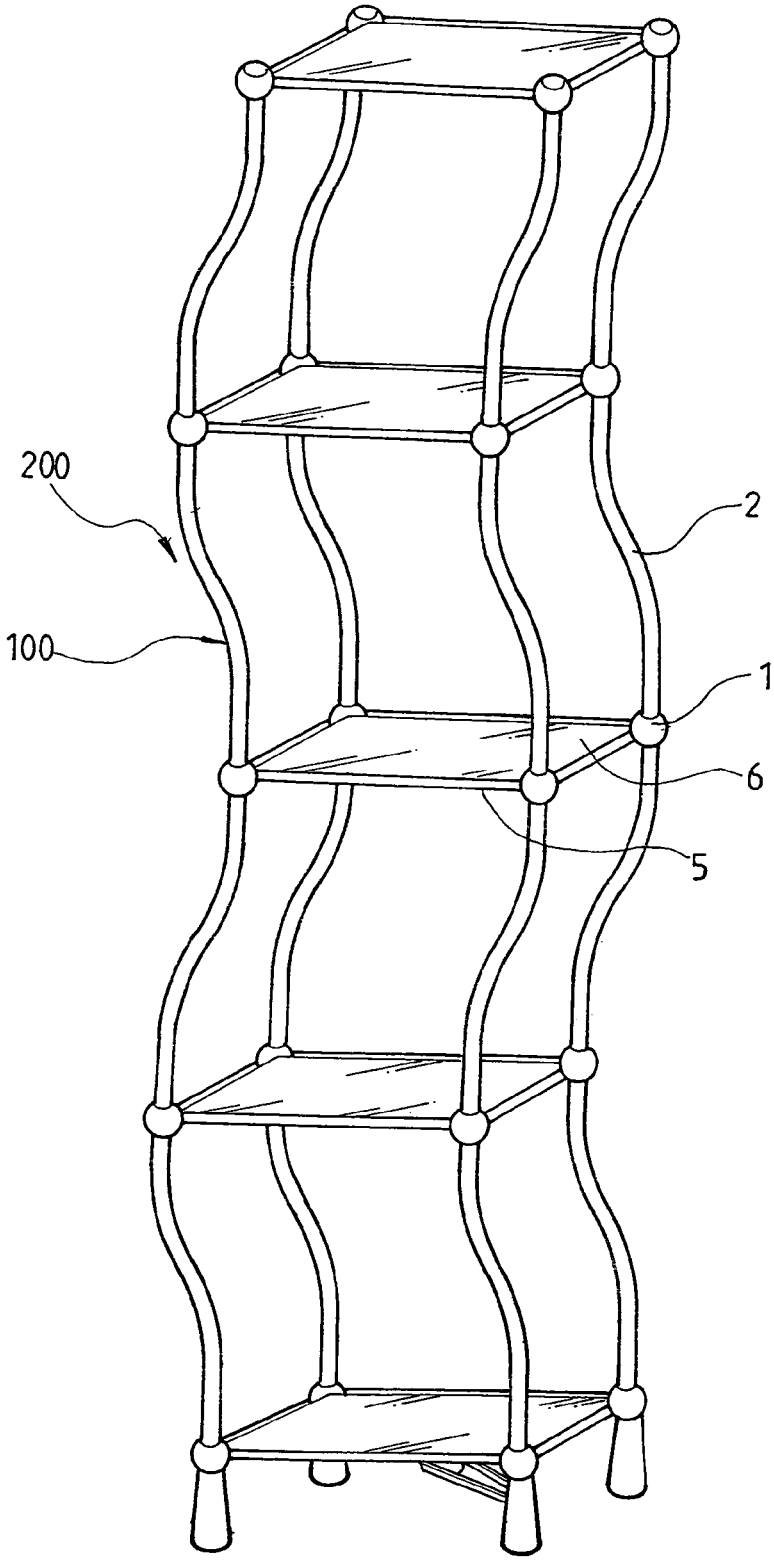
FIG. 9 shows the dynamic showing rack of FIG. 6 in a swinging state.

Please refer to FIG. 5. To use the dynamic showing rack 200 of the present invention, first position products on the flat shelves 6, and then start the motor 9 to turn the one main post 100 connected thereto. Since the main posts 100 are formed from a plurality of serially connected connecting posts 2 via knuckles 1, and any two connecting posts 2 at upper and lower sides of one knuckle 1 are obliquely extended in two different directions, the main posts 100 actually include a plurality of continuous bends at the knuckles 1. Therefore, when one of the main posts 100 is turned, the whole rack 200 is caused to turn and swing, which would attract consumers' attention.

FIGS. 6 to 9 shows a dynamic showing rack 200 according to a second embodiment of the present invention. The second embodiment is structurally similar to the first embodiment, except that the connecting posts 2 have flat upper and lower end surfaces 21, on each of which a fixing hole 22 is provided to communicate with a lateral screw hole 23, and that each of the connecting posts 2 includes a plurality of bends. After a plurality of connecting posts 2 are serially connected, with one another, a main post 100 showing continuous bends is formed. When the motor 9 is started to turn one of the main posts 100 connected thereto, the whole rack 200 formed from serially connected connecting posts 2 and knuckles 1 is brought to turn and swing to attract consumers' attention.

What is claimed is:

1. A dynamic showing rack, comprising four main posts, a plurality of crossbars and shelves, and a transmission mechanism; each of said main posts further comprising a plurality of knuckles, two connecting posts separately connected to each said knuckle, and a spindle mounted in each said knuckle to connect said two connecting posts to said knuckle;

each of said knuckles having flat upper and lower sides and a bearing mounted therein;

each of said connecting posts having beveled upper and lower end surfaces, a fixing hole provided on each said beveled end surface, and a lateral screw hole provided near each of said beveled end surfaces to communicate with said fixing hole;

each of said spindles being a round bar, and provided near upper and lower ends at two opposite sides with two recesses;

each said spindle being extended through said bearing mounted in each said knuckle with said upper and lower ends of said spindle set in said fixing holes on said beveled end surfaces of said two connecting posts connected to sides of said knuckle, respectively, such that said connecting posts obliquely extend from said knuckle in two different directions to show a series of bends on each said main post; and each said spindle being held in said connecting posts by extending screws through said lateral holes on said upper and lower connecting posts into said two opposite recesses at two ends of said spindle;

each of said crossbars being connected to and between two opposite knuckles on said four main posts, and said shelves being separately positioned on said crossbars; and said transmission mechanism including a motor connected to said spindle of one said connecting posts located at a lowest position of one of said four main posts; said motor, when being started, being adapted to turn said main posts and thereby bring said rack to turn and swing.

2. A dynamic showing rack, comprising four main posts, a plurality of crossbars and shelves, and a transmission mechanism; each of said main posts further comprising a plurality of knuckles, two connecting posts separately connected to each said knuckle, and a spindle mounted in each said knuckle to connect said two connecting posts to said knuckle;

each of said knuckles having flat upper and lower sides and a bearing mounted therein;

each of said connecting posts including a plurality of bends, having flat upper and lower end surfaces, a fixing hole provided on each said flat end surface, and a lateral screw hole provided near each of said flat end surfaces to communicate with said fixing hole;

each of said spindles being a round bar, and provided near upper and lower ends at two opposite sides with two recesses;

each said spindle being extended through said bearing mounted in each said knuckle with said upper and lower ends of said spindle set in said fixing holes on said flat end surface of said two connecting posts connected to upper and lower sides of said knuckle, respectively, such that said connecting posts extend from said knuckle in two opposite directions to show a series of bends on each said main post; and said spindle being held in said connecting posts by extending screws through said lateral holes on said connecting posts into said two opposite recesses at two ends of said spindle;

each of said crossbars being connected to and between two opposite knuckles on said main posts, and said shelves being separately positioned on said crossbars; and said transmission mechanism including a motor connected to said spindle of one said connecting posts located at a lowest position of one said four main posts; said motor, when being started, being adapted to turn said main posts and thereby bring said rack to turn and swing.

* * * * *